United States Patent [19]

Hynes

[11] Patent Number: 4,887,672

[45] Date of Patent: Dec. 19, 1989

[54] SUBSEA WELLHEAD WITH ANNULUS COMMUNICATING SYSTEM

[75] Inventor: Joseph H. Hynes, Houston, Tex.

[73] Assignee: Cameron Iron Works USA, Inc., Houston, Tex.

[21] Appl. No.: 285,585

[22] Filed: Dec. 16, 1988

[51] Int. Cl.[4] ..... E21B 33/035

[52] U.S. Cl. ..... 166/344; 166/88; 166/368; 73/151

[58] Field of Search ..... 166/336, 344, 348, 363, 166/368, 250, 88; 73/151

[56] References Cited

U.S. PATENT DOCUMENTS

| | | | |
|---|---|---|---|
| 3,974,690 | 8/1976 | Brock, Jr. et al. | 73/151 |
| 4,116,044 | 9/1978 | Garrett | 73/40.5 R |
| 4,202,410 | 5/1980 | Quebe | 166/88 |
| 4,410,186 | 10/1983 | Pierce, Jr. | 277/2 |
| 4,458,903 | 7/1984 | Tohill | 277/167.5 |

OTHER PUBLICATIONS

Federal Register, vol. 53, No. 63, Rules and Regulations, pp. 10730–10733.

*Primary Examiner*—William P. Neuder

[57] ABSTRACT

An improved subsea wellhead including a wellhead housing landed at a subsea well location and having a plurality of hangers landed therein, each of the hangers having a seal assembly to define an annulus in the area between the exterior of the hanger and the interior of the wellhead housing below the seal provided by the seal assembly and a passage in said wellhead housing communicating with each of the annuli, the passages extending through the wellhead housing and communicating with the space above the upper surface of the wellhead housing, a spool connected to the upper end of the wellhead housing, inner and outer seals between the upper end of the wellhead housing and the spool to define the space into which the passages communicate, a passage extending upward through the spool to communicate the pressure changes in the space between the spool and wellhead housing to the surface, and check valves in each of the passages allowing flow upwardly therethrough and preventing flow downwardly therethrough to isolate each of the annuli from the other annuli. In a modified form individual passages with suitable sealing means are provided for each of the wellhead housing passages.

9 Claims, 6 Drawing Sheets

SUBSEA WELLHEAD WITH ANNULUS COMMUNICATING SYSTEM

BACKGROUND

The present invention relates to an improved pressure communicating system for subsea wellhead annuli.

Recently the Minerals Management Service has issued new rules and regulations affecting oil and gas operations in the Outer Continental Shelf. (See Federal Register Apr. 1, 1988, pp. 10596 through 10777 and particularly 10730 through 10733). These rules include the requirement that it is necessary in such subsea wellheads to be able to monitor all annuli for pressure.

The disclosure of one prior patent (U.S. Pat. No. 4,116,044, issued Sept. 26, 1974) suggest the monitoring of a plurality of annuli within a wellhead at an unaccessible location by having pressure sensors extending through the wall of the wellhead to communicate with the annuli therein. These sensors are used to detect packoff leaks by detecting change of pressure under the seal after the area above the seal is pressurized. These sensors are connected to a junction box and to the surface to provide indication of the output of the sensors.

U.S. Pat. No. 4,410,186 issued Oct. 18, 1983, discloses a combination leakage detection system with a sealant injection system for pressurized flanged joints. The flanges include passages through the ring seal and through the flanges to provide for the detection of leakage and the maintenance of the seal.

U.S. Pat. No. 4,458,903, issued July 10, 1984, discloses a special tubular member to seal a control passage across a flanged joint. The control passage is stated as being applicable to subsurface safety valves. The tubular seal extends between flanges to provide a sealed continuation of the passage extending through the lower member and the passage extending through the upper flange to a needle control valve on its exterior.

U.S. Pat. No. 4,202,410, issued May 13, 1980, discloses a seal testing system for a wellhead joint in which test passages extend through the walls of the wellhead to the exterior to provide the indication of the pressure in the annulus to which each passage is connected.

U.S. Pat. No. 3,974,690, issued Aug. 17, 1976, discloses the sensing of vertical movement of a pressure responsive element to detect the change of pressure in an annulus. This involves lowering a sensing head into the wellhead to sense the position of the movable element and thus determine the pressure to which it has been exposed.

SUMMARY

The present invention is directed to the provision of a plurality of passages extending through the wellhead housing with one end of the passages connecting to one of a plurality of annuli within said wellhead housing and the opposite end of the passages communicating with an annulus defined in the joint between the upper end of the wellhead head housing and the spool connected thereto and with suitable communication from said annulus to the surface. In another form of the invention each of the passages which communicate with the annuli communicate directly to the surface.

An object of the present invention is to provide an improved system of communicating with the annuli of a subsea wellhead which does not provide a flow path from one annulus to another annulus.

Another object is to provide an improved system of communicating with the annuli of a subsea wellhead which does not penetrate completely through the wall of the subsea wellhead housing.

A further object of the present invention is to provide an improved system for communicating with the annuli of a subsea wellhead which includes the ability to bleed pressure from the annulus.

A still further object is to provide an improved system of communicating with the annuli of a subsea wellhead that may remain passive during drilling operations and become active automatically when the well is put on production.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
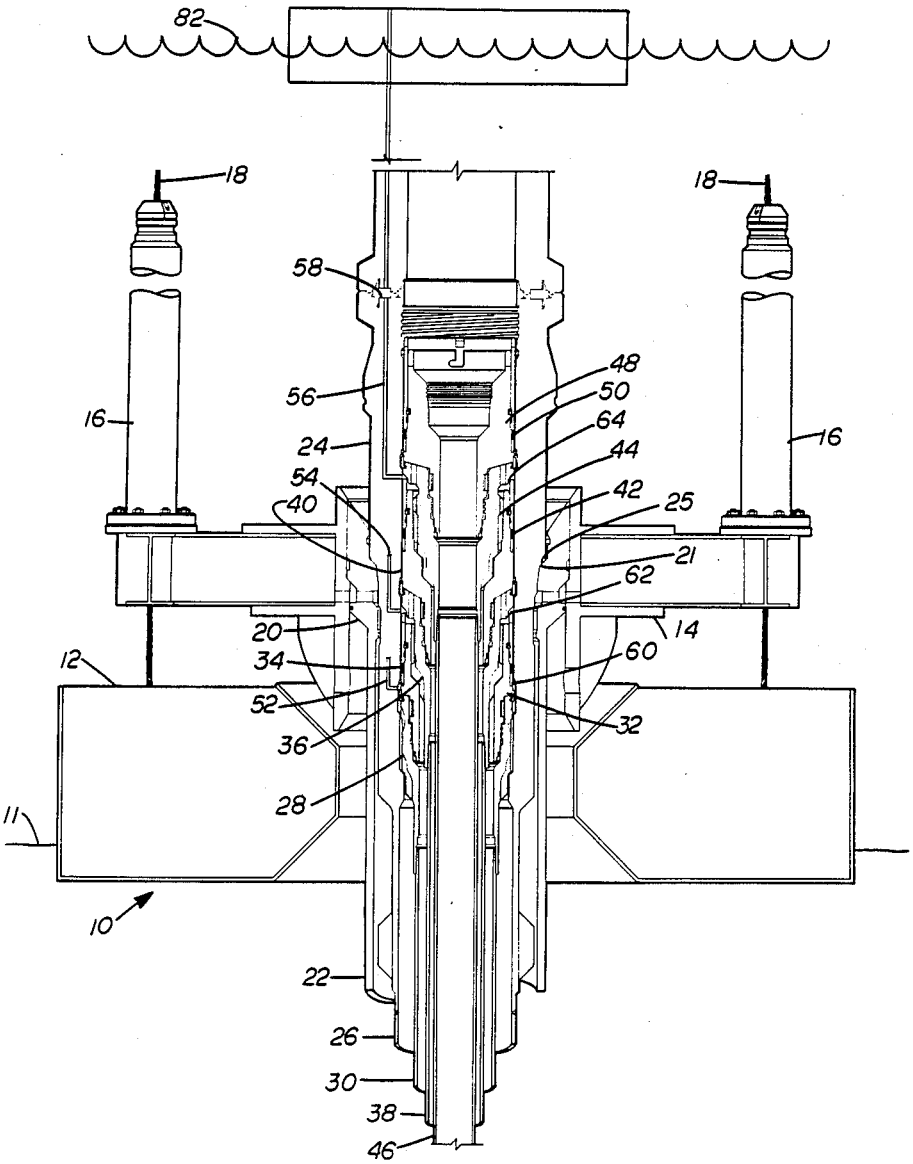
FIG. 1 is a sectional view of a subsea wellhead having the improved annuli monitoring system included therein.
Figure 2:
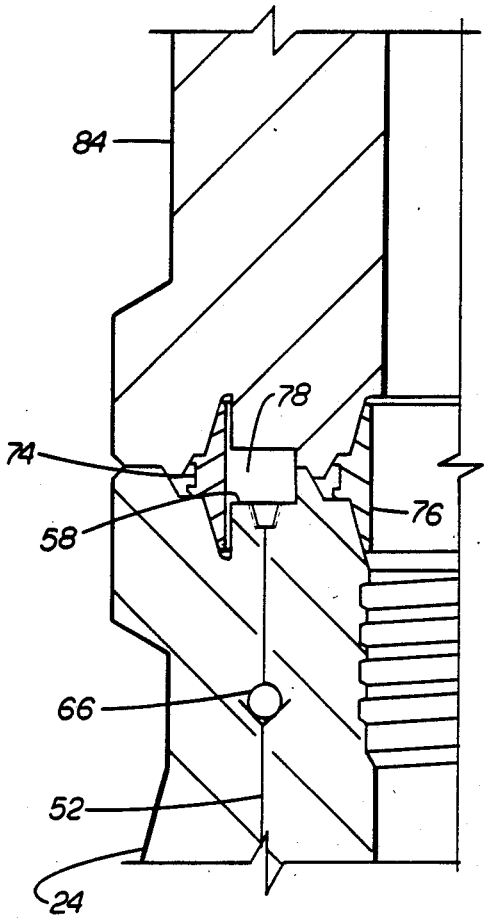
FIG. 2 is a quarter sectional view of the wellhead housing and its passages during drilling.

Subsea wellhead 10 illustrated in FIG. 1 is a typical subsea wellhead and includes landing base 12 positioned on the bottom 11 at the subsea location, guide base 14 having guide posts 16 and cables 18 extending upwardly for the landing of equipment on guide base 14, 30″ conductor housing 20 seated within guide base 14 with 30″ conductor 22 extending therebelow, an internal landing seat 21 in said conductor housing 20 and 18 ½″ housing 24 having an external shoulder 25 which is landed on said landing seat 21 within 30″ conductor housing 20 and has 20″ casing 26 extending therebelow. Large diameter hanger 28, i.e., a 13⅜″ hanger, is landed on the lower interior of housing 24 and has 13⅜″ casing 30 connected to its lower end and extending downwardly therefrom into the well bore. Seal assembly 32 is positioned to have its seal 34 in engagement between the exterior of hanger 28 and the interior of housing 24. Second hanger 36, which would be a 9⅝″ hanger, is landed on the interior of hanger 28 and its casing 38 extends downwardly therebelow. Seal assembly 40 is positioned to have its seal 42 in engagement between the exterior of second hanger 36 and the interior of housing 24. Third hanger 44, which would be a 7″ hanger, is landed on the interior of second hanger 36 and its casing 46 extends downwardly therebelow. Seal assembly 48 is positioned to have its seal 50 in engagement between the exterior of third hanger 44 and the interior of housing 24.

In order to monitor the annuli within housing 24, passages 52, 54 and 56 extending downwardly through housing 24 from its upper surface 58 and communicate respectively with annulus 60 below seal 34, with annulus 62 between seal 34 and seal 42 and with annulus 64 between seal 42 and seal 50 as shown in FIG. 1. Check valves 66, 68 and 70 are located in the upper ends of passages 52, 54 and 56 and are positioned to allow flow upwardly through the passages but to prevent flow downwardly therethrough and thus prevent communication between passages 52, 54 and 56 and annuli 60, 62 and 64.

With spool 72 connected to the upper end of housing 24 outer seal 74 and inner seal 76 are provided to seal between housing 24 and spool 72 and to define annulus 78 into which passages 52, 54 and 56 connect. Passage 80 extends axially through spool 72 and is in communication with annulus 78 at its lower end and provides means for communicating to the surface 82 either directly or through a suitable control line or other means so that there is an indication at the surface of any change in pressure within annulus 78.

Any suitable means such as a pressure gage may be use to detect build-up of pressure in the annuli which are connected to the surface 82 by the single passage 80. It should be noted that any pressure which is detected will provide only an indication that it is one of the annuli but will not tell the driller which one. As is well known in the art, pressure accumulating in the annulus normally will be bled from the annulus so that such pressure is not allowed to remain in the annulus. Additionally, if there is any workover to be done on the well, it is advantageous to be able to bleed pressure from the annulus prior to unseating the hanger seal. Passage 80 can function to allow bleeding therethrough. One of the ways in which the accumulation of pressure may be detected is by detecting the flow out the end of passage 80 at the surface. This may be done by feel, visually or by suitable instrumentation. This flow provides the indication of the problem and at least the initial solution to the problem by bleeding of the pressure from the annulus.

Figure 3:
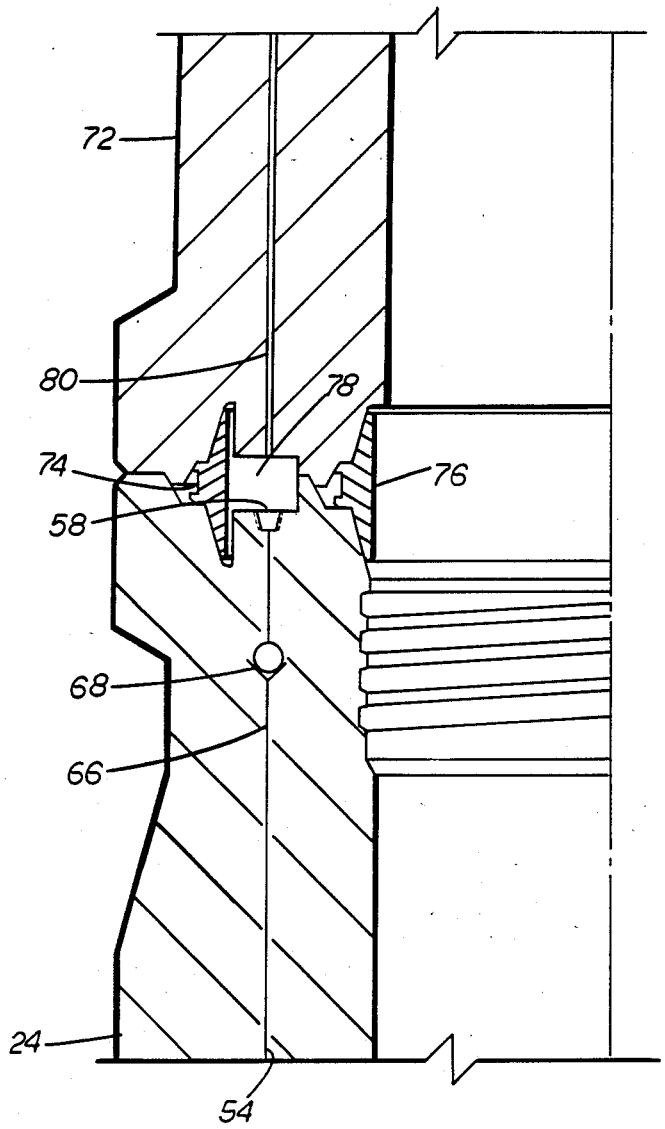
FIG. 3 is a quarter sectional view of the wellhead housing and spool clamped connection to illustrate the relationship between the individual passages communicating axially through the housing to each other and to the annulus created in the flanged connection and to the single passage through the spool to communicate pressure changes to the surface.
Figure 4:
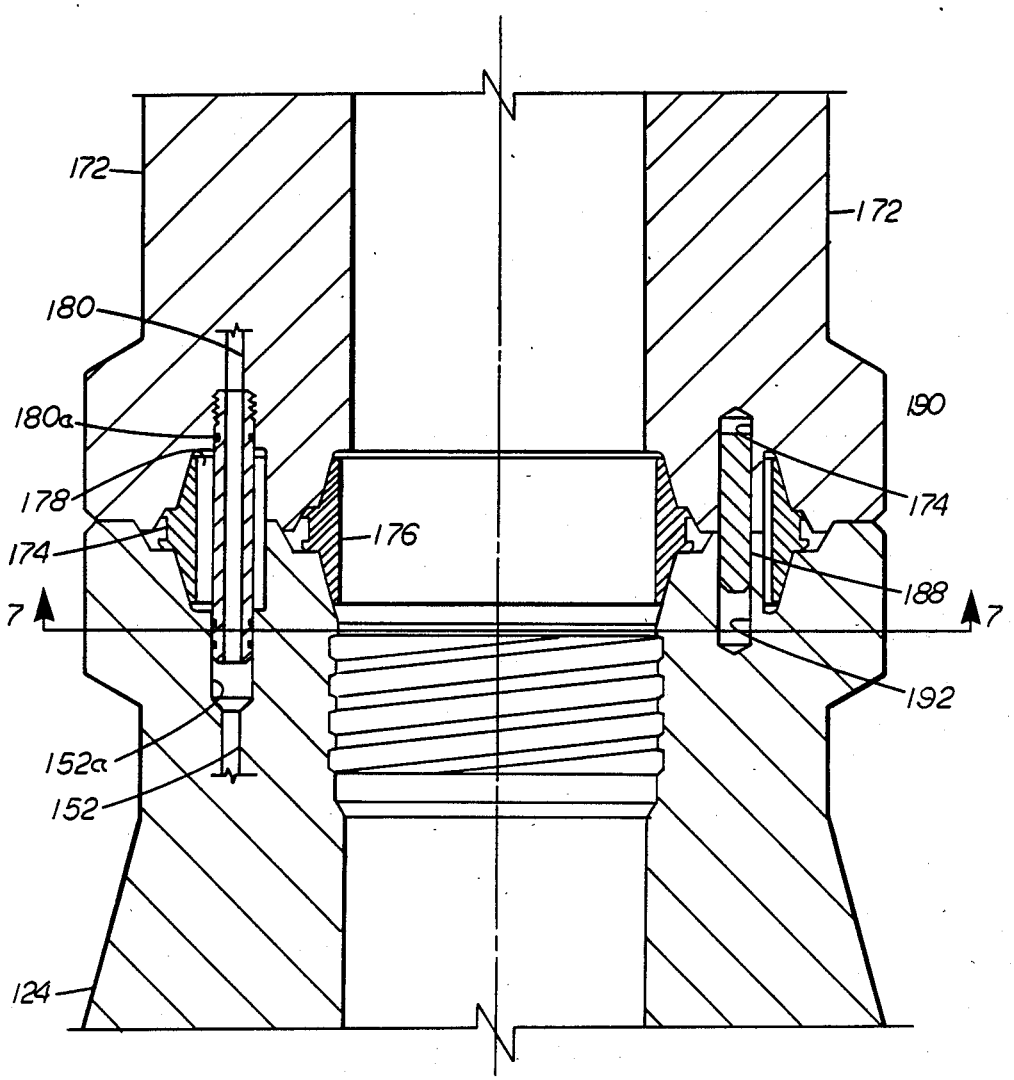
FIG. 4 is a sectional view of a modified form of the present invention taken along line 4—4 in FIG. 7.
Figure 5:
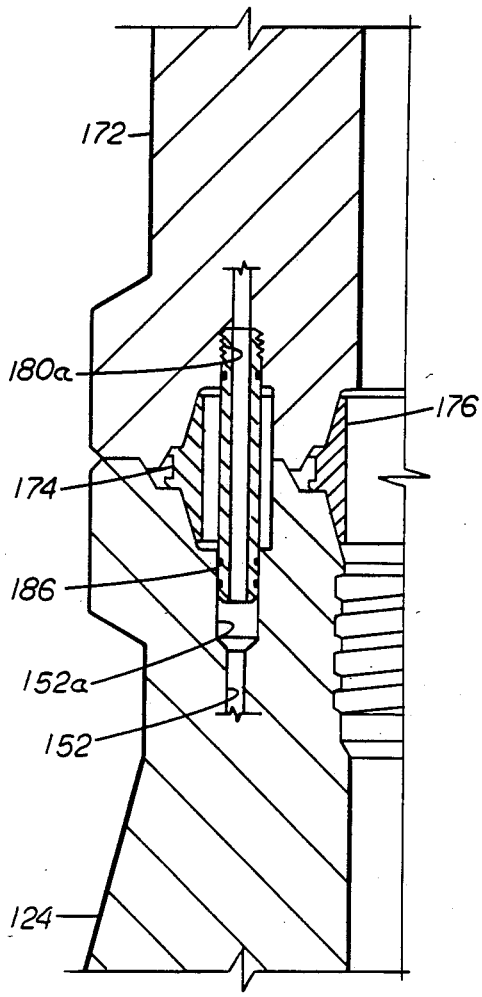
FIG. 5 is a detail sectional view of the tube extending between the wellhead housing passage and the spool passage above the housing.

During drilling operations blowout preventer 84 or other suitable spool is secured above wellhead housing 24 as shown in FIG. 3 and no communication is provided therethrough so that the passages 52, 54 and 56 remain passive during the drilling operations.

A modified form of the present invention is shown in FIGS. 4, 5, 6 and 7 with wellhead housing 124 having passages 152, 154 and 156 extending therethrough to communicate with the annuli. The upper ends of passages 152, 154 and 156 terminate at the upper end of wellhead housing 124 and each of such passages is provided with a counter bore, such as 152*a* shown in FIG. 5 which receives tube 186. Tube 186 is threaded into counterbore 180*a* at the lower end of passage 180 in spool 172, extends across annulus 178 and includes seals for sealing against the interior of counterbores 180*a* and 152*a*. With each of passages through wellhead housing 124 being in direct communication with one of the passages 180 through spool 172, no check valves are needed to ensure that there is no intercommunication between passages 152, 154 and 156. In this manner communication is established between the annuli and the surface. With this structure flow can be provided from the surface to the individual annuli and each of the annuli is connected so that its pressure can be monitored at the surface. Alternately, check valves could be provided in the counterbores 152*a*, 154*a* and 156*a* which are of the type well known in the art that are sealed until "stung open" by the tube 186. This would ensure that not intercommunication as noted above, and would allow no pressure to be released from an annulus until the appropriate time.

Figure 6:
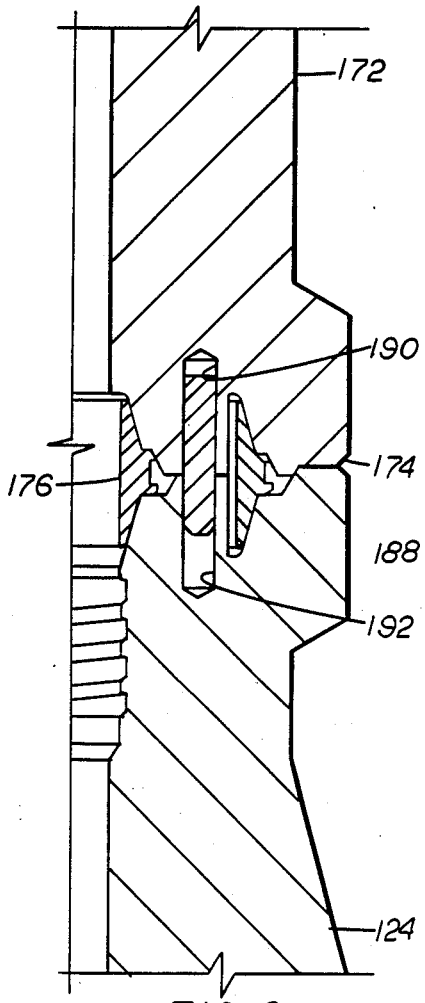
FIG. 6 is a detail sectional view of one of the orienting pins providing proper connection between the wellhead housing and the spool landed thereon.
Figure 7:
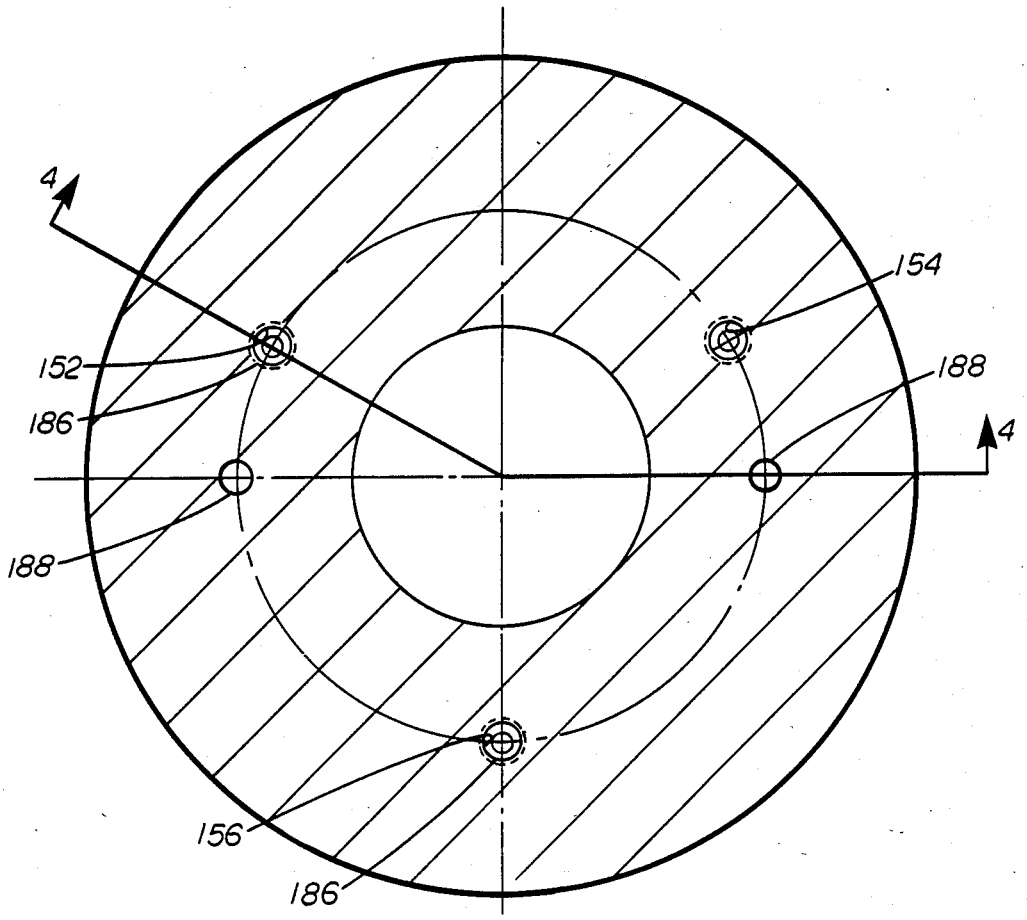
FIG. 7 is a transverse sectional view of the orienting pins and the tubes connecting the passages between the wellhead housing and the spool landed thereon.

In the installation of spool 172, some orientation is provided so that the desired communication between the passages in wellhead housing and the passages in spool 172 is established. This is shown in FIGS. 6 and 7 wherein the relative positions of tubes 186 and alignment pins 188 are shown. Alignment pins 188 are held in recesses 190 in the lower end of spool 172 and are adapted to be received within recesses 192 in the upper end of wellhead housing 124 as shown in FIG. 6. With the pattern of the pins 188 and the tubes 186 as shown in FIG. 7, there is only one position in which the spool 172 can be landed on wellhead housing 124 and that is with the desired communication established by tubes 186 between the passages 152, 154 and 156 and their mating passages (passage 180 being shown) to the surface 182.

Suitable means well known in the art, such as a pressure gage may be provided to detect the rise of pressure in the passages leading to the surface, such as passage 180. Since each annulus has a separate passage to the surface the detection of a rise of pressure in any of the passages indicates the annulus which is experiencing the pressure rise. Also, as in the form of the invention previously discussed, the passages may be used to provide the initial relief from the pressure rise by allowing such pressure to bleed therefrom through the passage.

With the improved structure of the present invention, indication is provided of any change in pressure in any of the annuli to comply with the above mentioned regulations and to allow the operator to take steps to control the condition if it needs controlling.

What is claimed is:

1. A subsea wellhead comprising a wellhead housing having an interior surface, an upper surface and a landing seat at the lower end of the inner surface, a series of hangers landed within said wellhead housing, each of said hangers having an exterior sealing surface, a series of seal assemblies having a seal for sealing between the exterior sealing surface of a hanger and the interior surface of said wellhead housing, the sealing of said seal assemblies providing a plurality of annuli between the hangers and the wellhead housing, a plurality of passages in said wellhead housing communicating from the upper surface of said wellhead housing to said annuli with each of said passages communicating with a single one of the annuli, means associated with said passages for isolating said annuli from each other and to prevent flow from one annulus into another, and means for communicating fluid pressure changes at the upper surface of said wellhead housing to said surface.

2. A subsea wellhead according to claim 1 wherein said passages each extend axially through said wellhead housing and then radially inward into communication with the annulus with which it is to communicate.

3. A subsea wellhead according to claim 1 wherein said seal assemblies define a first annulus below the lowest seal assembly and the interior of said housing and a second annulus between said seal assemblies, and one of said passages communicates with said first annulus and another of said passages communicates with said second annulus.

4. A subsea wellhead according to claim 1 wherein there are three seal assemblies including a lower seal assembly, an intermediate seal assembly and an uppers seal assembly, said seal assemblies defining a lower annulus below the lower seal assembly, an intermediate annulus between the lower seal assembly and the intermediate seal assembly and an upper annulus between the intermediate seal assembly and the upper seal assembly, three passages extend through said housing including a first passage, a second passage and a third passage, and said first passage communicates with said first annulus, said second passage communicates with said second annulus and said third passage communicates with said third annulus.

5. A subsea wellhead according to claim 1 wherein said passage isolating means includes a check valve in each of said passages to prevent flow between said annuli.

6. A subsea wellhead according to claim 1 wherein said passage isolating means includes a structure secured to the upper end of said wellhead housing and having a passage extending axially therethrough for each of said passages through said wellhead housing, and means extending between the upper end of said wellhead housing and said structure to provide a seal communication between the passages in said wellhead housing and the passages in the structure.

7. A subsea wellhead according to claim 6 including orienting means provided between said structure and the wellhead housing to connect the communication sealing means between the passages in the housing and the structure.

8. A subsea wellhead according to claim 1 wherein said housing and said hangers each include a tubular member extending downwardly therefrom.

9. A subsea wellhead according to claim 1 including a base positioned at the subsea location, a conductor housing supported in said base and having an internal landing seat, said wellhead housing being positioned within said conductor housing and having an external seat which is landed in engagement with said conductor housing internal landing seat.

* * * * *